US010232230B2

(12) United States Patent
Takehara et al.

(10) Patent No.: US 10,232,230 B2
(45) Date of Patent: Mar. 19, 2019

(54) MULTI-MATERIAL GOLF CLUB HEAD

(71) Applicant: Acushnet Company, Fairhaven, MA (US)

(72) Inventors: Doug M. Takehara, Encinitas, CA (US); Gentry Ferguson, Encinitas, CA (US); Mark C. Myrhum, Del Mar, CA (US)

(73) Assignee: Acushnet Company, Fairhaven, MA (US)

( * ) Notice: Subject to any disclaimer, the term of this patent is extended or adjusted under 35 U.S.C. 154(b) by 212 days.

(21) Appl. No.: 15/047,975

(22) Filed: Feb. 19, 2016

(65) Prior Publication Data

US 2017/0136316 A1 May 18, 2017

Related U.S. Application Data

(63) Continuation-in-part of application No. 14/945,243, filed on Nov. 18, 2015, now Pat. No. 10,065,084.

(51) Int. Cl.

| | |
|---|---|
| ***A63B 53/04*** | (2015.01) |
| ***A63B 60/52*** | (2015.01) |
| ***A63B 60/50*** | (2015.01) |
| *A63B 60/00* | (2015.01) |

(52) U.S. Cl.

CPC ..... *A63B 53/0466* (2013.01); *A63B 60/50* (2015.10); *A63B 60/52* (2015.10); *A63B 2053/0408* (2013.01); *A63B 2053/0433* (2013.01); *A63B 2053/0437* (2013.01);

(Continued)

(58) Field of Classification Search

USPC ..... 473/345, 346, 349

See application file for complete search history.

(56) References Cited

U.S. PATENT DOCUMENTS

| | | | |
|---|---|---|---|
| 4,076,254 | A | 2/1978 | Nygren |
| 4,139,196 | A | 2/1979 | Riley |
| 4,229,550 | A | 10/1980 | Jones et al. |

(Continued)

FOREIGN PATENT DOCUMENTS

| | | |
|---|---|---|
| GB | 2450764 | 7/2009 |
| JP | H05-7261 | 2/1993 |

(Continued)

OTHER PUBLICATIONS

The Royal and Ancient Golf Club of St. Andrews and USGA, Technical Description of the Pendulum Test revised version, Nov. 2003.

(Continued)

*Primary Examiner* — Nini Legesse

(74) *Attorney, Agent, or Firm* — Randy K. Chang

(57) ABSTRACT

A golf club head made out of multi-material is disclosed herein. More specifically, the golf club head in accordance with the present invention has at least a portion of the body of the golf club head that is further comprised out of a base layer and a lightweight cover layer. The base layer may have a plurality of cutouts to help reduce unnecessary mass and the lightweight cover layer may be made out of an ultra-lightweight material to further reduce the unnecessary mass. The resulting golf club head may generally have a deep CG wherein the CG-B location is about 37 mm, and a CG-C location is greater than about 30 mm.

11 Claims, 17 Drawing Sheets

(52) U.S. Cl.
CPC ..... *A63B 2060/002* (2015.10); *A63B 2209/00* (2013.01); *A63B 2209/02* (2013.01)

(56) References Cited

U.S. PATENT DOCUMENTS 4,448,941 A 5/1984 Cheung et al.
4,681,322 A 7/1987 Straza et al.
5,058,895 A 10/1991 Igarashi
5,132,178 A 7/1992 Chyung et al.
5,163,682 A 11/1992 Schmidt et al.
5,238,529 A 8/1993 Douglas
5,295,689 A 3/1994 Lundberg
5,310,185 A 5/1994 Viollaz et al.
5,346,216 A 9/1994 Aizawa
5,358,249 A 10/1994 Mendralla
5,362,055 A 11/1994 Rennie
5,380,010 A 1/1995 Werner
5,403,007 A 4/1995 Chen
5,405,136 A 4/1995 Hardman
5,425,538 A 6/1995 Vincent et al.
5,499,814 A 3/1996 Lu
5,524,331 A 6/1996 Pond
5,547,427 A 8/1996 Rigal
5,570,886 A 11/1996 Rigal
5,624,331 A 4/1997 Lo
5,720,673 A 2/1998 Anderson
5,743,813 A 4/1998 Chen et al.
5,839,975 A 11/1998 Lundberg
5,967,903 A 10/1999 Cheng
5,997,415 A 12/1999 Wood
6,152,833 A 1/2000 Werner
6,440,008 B2 8/2002 Murphy et al.
6,533,681 B2 3/2003 Inoue et al.
6,558,271 B1 5/2003 Beach
6,605,007 B1 8/2003 Bissonnette et al.
6,617,013 B2 9/2003 Morrison et al.
6,623,543 B1 9/2003 Zeller et al.
6,837,094 B2 1/2005 Pringle et al.
6,860,824 B2 3/2005 Evans
6,945,876 B2 9/2005 Nakahara et al.
7,037,214 B2 5/2006 Nakahara et al.
7,056,229 B2 6/2006 Chen
7,074,136 B2 7/2006 Noguchi et al.
7,108,614 B2 9/2006 Lo
7,140,974 B2 11/2006 Chao et al.
7,258,624 B2 8/2007 Kobayashi
7,267,620 B2 9/2007 Chao et al.
7,281,991 B2 10/2007 Gilbert et al.
7,281,994 B2 10/2007 De Shiell et al.
7,331,877 B2 2/2008 Yamaguchi et al.
7,347,796 B2 3/2008 Takeda
7,361,100 B1 4/2008 Morales
7,422,528 B2 9/2008 Gibbs et al.
7,448,964 B2 11/2008 Schweigert
7,497,789 B2 * 3/2009 Burnett ..... A63B 53/0466 473/342
7,510,485 B2 3/2009 Yamamoto
7,510,486 B2 3/2009 Werner
7,628,712 B2 12/2009 Chao et al.
7,632,193 B2 12/2009 Thielen
7,632,195 B2 12/2009 Jorgensen
7,686,708 B2 3/2010 Morales
7,798,203 B2 9/2010 Schweigert
7,861,395 B2 1/2011 Jorgensen
7,867,612 B2 1/2011 Schwung et al.
7,931,546 B2 4/2011 Bennett et al.
8,172,697 B2 5/2012 Cackett
8,221,261 B2 7/2012 Curtis et al.
8,247,062 B2 8/2012 Morrison et al.
8,293,356 B2 10/2012 Merrill et al.
8,419,569 B2 4/2013 Bennett et al.
8,475,292 B2 7/2013 Rahrig et al.
8,496,542 B2 7/2013 Curtis et al.
8,517,859 B2 8/2013 Golden et al.
8,540,588 B2 * 9/2013 Rice ..... A63B 53/0466 473/334
8,540,590 B2 9/2013 Tsukada et al.
8,597,139 B2 12/2013 Jorgensen
8,715,109 B2 5/2014 Bennett et al.
8,758,161 B2 6/2014 Golden et al.
8,777,778 B2 7/2014 Solheim et al.
8,790,196 B2 7/2014 Solheim et al.
8,814,723 B2 8/2014 Tavares et al.
8,864,602 B2 10/2014 Curtis et al.
8,876,629 B2 11/2014 Deshmukh et al.
9,079,078 B2 7/2015 Greensmith et al.
9,079,089 B2 7/2015 Lokken et al.
9,079,368 B2 7/2015 Tavares et al.
9,101,811 B1 8/2015 Goudarzi et al.
2004/0192468 A1 9/2004 Onoda
2005/0096154 A1 5/2005 Chen
2005/0143189 A1 6/2005 Lai et al.
2009/0088272 A1 4/2009 Foster et al.
2009/0092831 A1 4/2009 Stusgen et al.
2009/0105010 A1 * 4/2009 De La Cruz ..... A63B 53/0466 473/345
2009/0286615 A1 * 11/2009 De La Cruz ..... A63B 53/0466 473/282
2012/0142451 A1 6/2012 De Shiell
2013/0252757 A1 9/2013 Deshmukh et al.
2014/0106897 A1 4/2014 Golden et al.
2015/0108681 A1 4/2015 Deshmukh et al.
2015/0290503 A1 10/2015 Su
2015/0298196 A1 10/2015 Su

FOREIGN PATENT DOCUMENTS

JP 2003-250938 A 9/2003
JP 2004-159794 6/2004
JP 2004-208728 7/2004
JP 2005-058461 3/2005
JP 2005-323686 11/2005
JP 2005-329154 12/2005
JP 2005-348895 12/2005
JP 2006-020860 1/2006
JP 2008-148762 A 3/2008
JP 2009-011839 1/2009
JP 2014-501167 1/2014

OTHER PUBLICATIONS

Machine Translation of JPH05-7261.

* cited by examiner

MULTI-MATERIAL GOLF CLUB HEAD

CROSS REFERENCE TO RELATED APPLICATIONS

This application is a continuation-in-part (CIP) of U.S. patent application Ser. No. 14/945,243, filed Nov. 18, 2015, the disclosure of which is incorporated by reference in its entirety.

FIELD OF THE INVENTION

The present invention relates generally to an improved golf club head wherein a portion of the golf club head is made out of a multi-layered lightweight material. Using this lightweight material at different portions of the golf club head allows more discretionary mass to be created, which can be used to further improve the performance of the golf club by manipulating the center of gravity and moment of inertia of the golf club head.

BACKGROUND OF THE INVENTION

It is generally understood in the industry that the performance of a golf club head is largely dependent on the location of the Center of Gravity (CG) and Moment of Inertia (MOI) of the golf club head. In order to adjust the CG and MOI of a golf club head, golf club designers often strategically place mass at specific locations within the golf club head to achieve the desired CG and MOI. Pursuant to the design objective above, golf club designers have constantly struggled with ways to reduce unnecessary mass from various portions of the golf club in order to strategically place it at more desirable portions. This process is so important to the design of a golf clubs; the golf club design industry even has a specific term used to describe this type of mass savings, called "discretionary mass".

U.S. Pat. No. 6,152,833 to Werner et al. illustrates one of the earlier examples of trying to create more discretionary mass by creating a lightweight low density striking face that is supported to its rear by a hollow shell structure.

U.S. Pat. No. 6,860,824 to Evans illustrates another example of golf club designers attempt in creating more discretionary mass. In U.S. Pat. No. 6,860,824 it is contemplated that a golf club head has a body portion that is preferably composed of a lightweight non-metallic material to help reduce mass from the body portion of the golf club head.

U.S. Pat. No. 5,624,331 to Lo et al. illustrates another example of increasing discretionary mass by creating a composite-metal wood-style golf club head having a metal casing with at least two openings in the crown in which composite covers are disposed.

Finally, U.S. Pat. No. 7,361,100 to Morales et al. illustrates a modern day example of utilizing modern day materials to increase the discretionary mass within a golf club. More specifically, U.S. Pat. No. 7,361,100 discloses a golf club head that is formed with a crown having an aperture with an arcuate rear edge and a forward edge that is substantially parallel to the striking face, wherein the opening formed in the aperture by the ribs are filled with an organic-composite material such as carbon fiber epoxy.

It should be noted that although all of the above referenced prior art are very capable of reducing unnecessary mass from various portions of the golf club head, it fails to address the ancillary drawback associated with the usage of lightweight materials such as graphite composite. When lightweight materials are used to replace metallic materials at various portions of the golf club, the sound and feel of the golf club can significantly degrade, resulting in a undesirable golf club. Hence it can be seen from the above that although the current art is capable of creating discretionary mass by using lightweight materials, it fails to do so while minimizing the undesirable sound and feel of the golf club.

BRIEF SUMMARY OF THE INVENTION

One aspect of the present invention is a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%.

In another aspect of the present invention, a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%, and the base layer has a maximum thickness of less than about 0.50 mm and the lightweight cover layer has a maximum thickness of less than about 0.30 mm.

In another aspect of the present invention the club head has a Center of Gravity location having a CG-C location greater than about 30 mm.

In another aspect of the present invention is a golf club head comprising of a frontal portion including a striking face portion, defined as any portion of said golf club head located forward of a bifurcation line, the bifurcation line is defined as a plane placed at a distance of 10 mm behind a hosel bore axis. The golf club head also comprises of a rear portion further comprising a lightweight rear toe portion, a lightweight rear heel portion, and a rear central portion; defined by a plurality of trifurcation lines placed at a distance of 15 mm on both sides of a geometric center of a striking face. A mass of the rear central portion is greater than a mass of said lightweight rear heel portion, and the mass of the rear central portion is greater than a mass of the lightweight rear toe portion.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
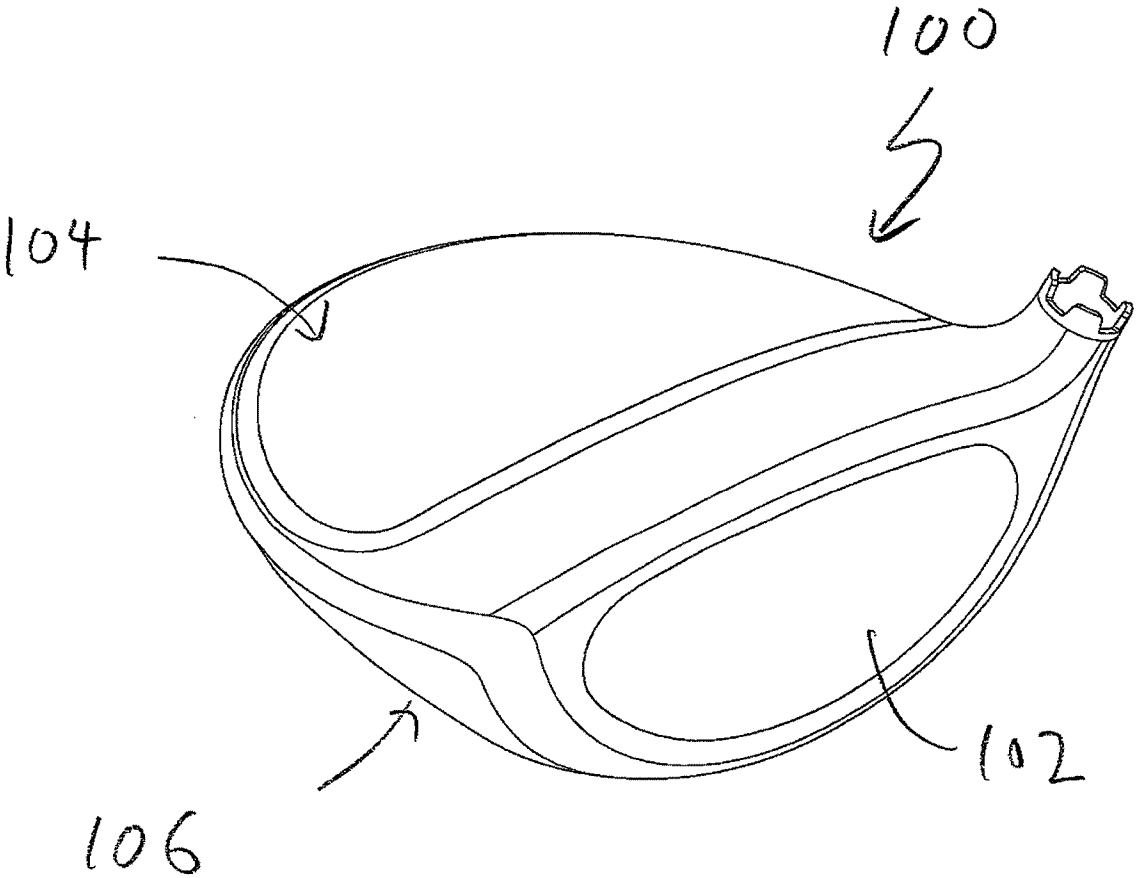
FIG. 1 of the accompanying drawings shows a perspective view of a golf club head in accordance with a preferred exemplary embodiment of the present invention.

FIG. 1 shows a perspective view of a golf club head 100 in accordance with an exemplary embodiment of the present invention. Golf club head 100 shown in FIG. 1 may generally have a striking face 102 attached to a frontal portion of the golf club head 100 and a body portion attached to an aft portion of the striking face 102. The body portion may generally be further comprised of a crown portion 104 near a top of the golf club head 100 and a sole portion 106 located near a bottom of the golf club head 100. Finally, and most importantly, the crown portion 104 of the golf club head 100 in accordance with the exemplary embodiment of the present invention may be further comprised out of multiple layers that have different materials. Alternatively speaking, it can be said that the golf club head 100 in accordance with an exemplary embodiment of the present invention may have a multi-material crown.

Figure 2:
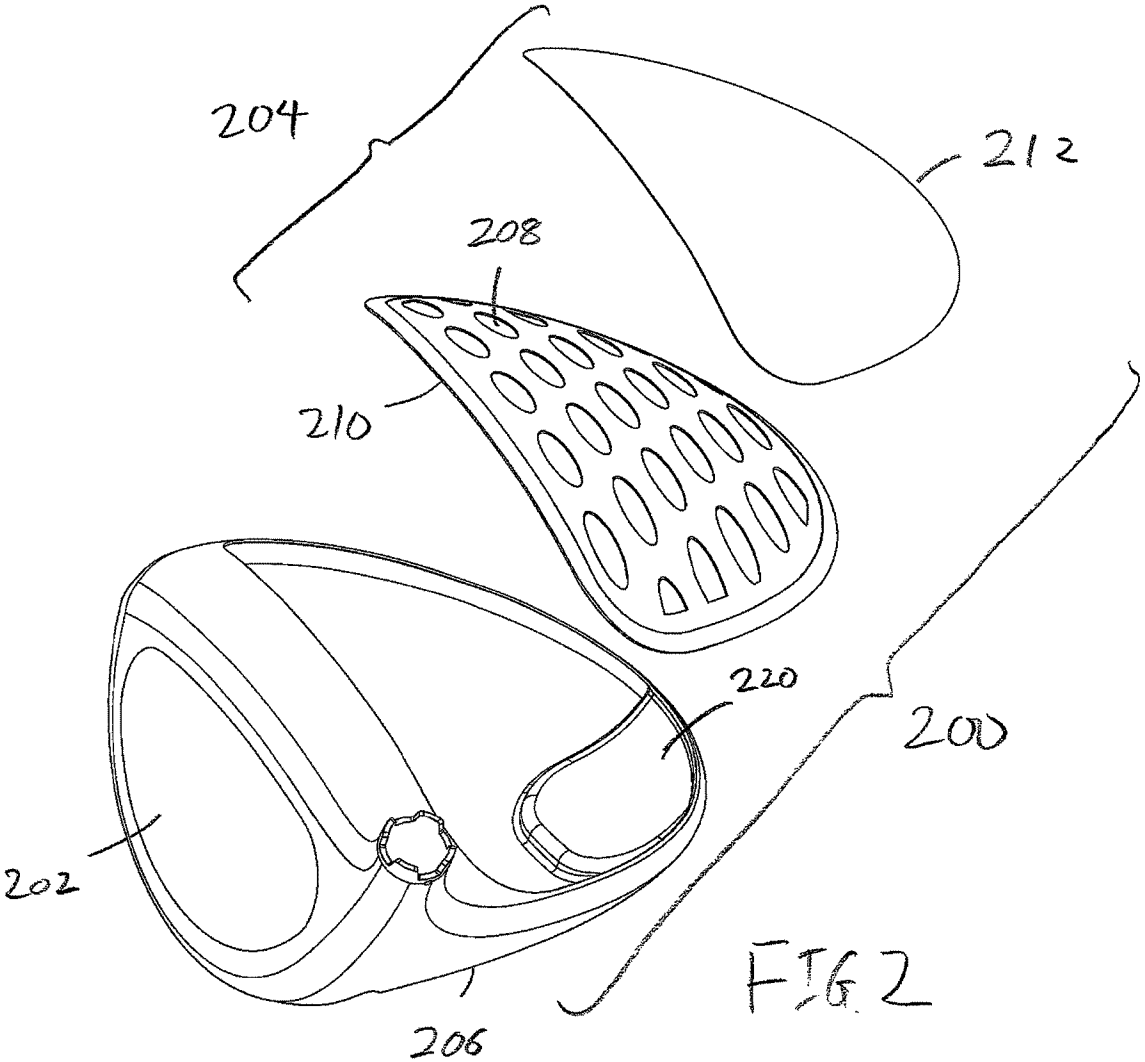
FIG. 2 of the accompanying drawings shows an exploded perspective view of a golf club head in accordance with the embodiment of the present invention shown in FIG. 1.

In order to provide a more clear illustration of the various components of the golf club head 100 in accordance with this exemplary embodiment of the present invention FIG. 2 is provided herein. FIG. 2 shows an exploded perspective view of a golf club head 200 illustrating that the multi-material crown portion 204 may be further comprised out of a base layer 210 and a lightweight cover layer 212.

The base layer 210 may generally be comprised out of a titanium type material with a density of between 4.0 g/cm$^3$ and about 4.7 g/cm$^3$, more preferably between about 4.1 g/cm$^3$ and about 4.6 g/cm$^3$, and most preferably about 4.4 g/cm$^3$. This titanium base layer 210 not only serves to help provide structural rigidity to the crown portion 204 of the golf club head 200, but can also help contribute to the generation of discretionary mass by incorporating a plurality of cutouts 208 across the entire area. The plurality of cutouts 208 shown in this exemplary embodiment of the present invention may generally be oval or circular shaped in order to provide the most mass savings all while preserving the structural integrity of the base layer 210. However, it should be noted that although the oval or circular shaped cutouts 208 are preferred, many other types of cutout 208 geometry can be used to remove material from the base layer 210 without departing from the scope and content of the present invention.

When holes are cut out from a material, it is generally understood that the structural rigidity of the material may suffer. Hence, in order to address the potential degradation of the structural rigidity in the crown portion 204 due to the plurality of cutouts 208, the present invention may utilize a combination of different technologies. First and foremost, the present invention attempts to recapture some of the lost structural rigidity by utilizing a higher strength titanium material for the base layer 210. In one preferred embodiment of the present invention ATI 425 Titanium material is used; however, numerous other high strength material such as SP 700 Titanium, KS 120 Titanium, KS 100 Titanium, Titanium 8-1-1—may all be used without departing from the scope and content of the present invention so long as it provides an elevated strength performance. In addition to the utilization of a high strength titanium material for the base layer 210, the present invention also utilizes a lightweight cover layer 212.

The lightweight cover layer 212 shown in FIG. 2 may generally be a lightweight material with a density that is lower than the density of the base layer 210, sole 206, and the striking face 202. In one exemplary embodiment the layer of lightweight material 210 may be constructed using an aluminum material with a density of about 2.7 g/cm$^3$, a magnesium material with a density of about 1.738 g/cm$^3$, a composite type material with a density of about 1.50 g/cm$^3$, or any other material having a lower density than the density of the first material all without departing from the present invention. In a preferred embodiment of the present invention the material used to create lightweight cover layer 212 may generally be a composite material having a very low fiber areal mass. More information regarding composite materials with a low fiber areal mass in a golf club head may be found in U.S. patent application Ser. No. 14/834,654 by Deshmukh, the disclosure of which is incorporated by reference in its entirety.

The combination of the base layer 210 and the lightweight cover layer 212 allows the golf club head 200 to achieve the maximum amount of discretionary mass all while preserving the structural rigidity in the crown 204 portion to be able to endure the high impact stressed between a golf club 200 and a golf ball. The amount of discretionary mass saved from the crown 204 portion can then easily be applied to more strategic locations within a golf club head 200.

One exemplary location of this more strategic location of discretionary mass can also be seen in FIG. 2 in the form of a mass member 220. In the current exemplary embodiment of the present invention, the discretionary mass may be concentrated towards the rear sole portion of the golf club head 200, however the mass member 220 could be located at alternative locations within the golf club head 200 without departing from the scope and content of the present invention. In the current exemplary embodiment of the present invention the amount of additional mass located in the mass member may generally be greater than about 5 grams, more preferably greater than about 7 grams, and most preferably greater than about 9 grams without departing from the scope and content of the present invention.

Figure 3:
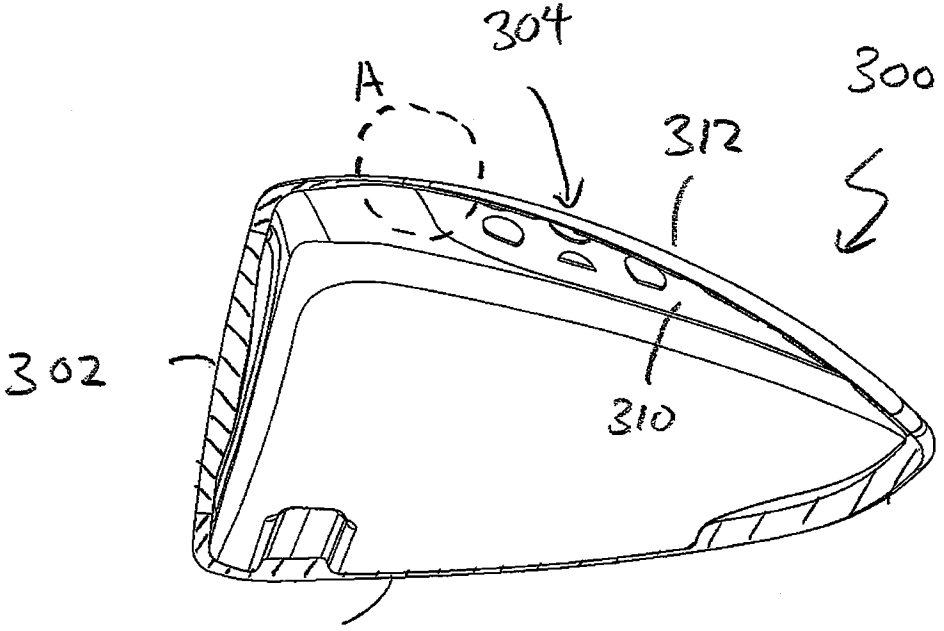
FIG. 3 of the accompanying drawings shows a cross-sectional view of the golf club head shown in FIG. 1, taken down the middle of the golf club head in a forward and aft orientation.

In order to illustrate how the various components interact with each other in an assembled setting, FIG. 3 of the accompanying drawing is provided illustrating a cross-sectional view of a golf club head 300. This cross-sectional area is taken along the center of the golf club head in a forward aft orientation, passing through the center of the striking face. In this cross-sectional view we can see that the golf club head 300 still has a striking face 302, a crown portion 304, and a sole portion 306. The crown portion 304, as previously illustrated in the exploded view shown in FIG. 2, may be further comprised out of a base layer 310 and a lightweight cover layer 312. First and foremost, it can be seen that the thickness of the crown portion 304 is extremely small, allowing the golf club head 300 to achieve the discretionary mass that is desired. Given how thin the entire thickness of the crown portion 304 is, it can be easily deduced that the lightweight cover 312 could be even thinner. In order to illustrate the thickness of the crown portion 304 together with the base layer 310 as well as the lightweight cover layer 312, FIG. 4 is provided, which focuses on an enlarged cross-sectional view of circular region A shown in FIG. 3.

Figure 4:
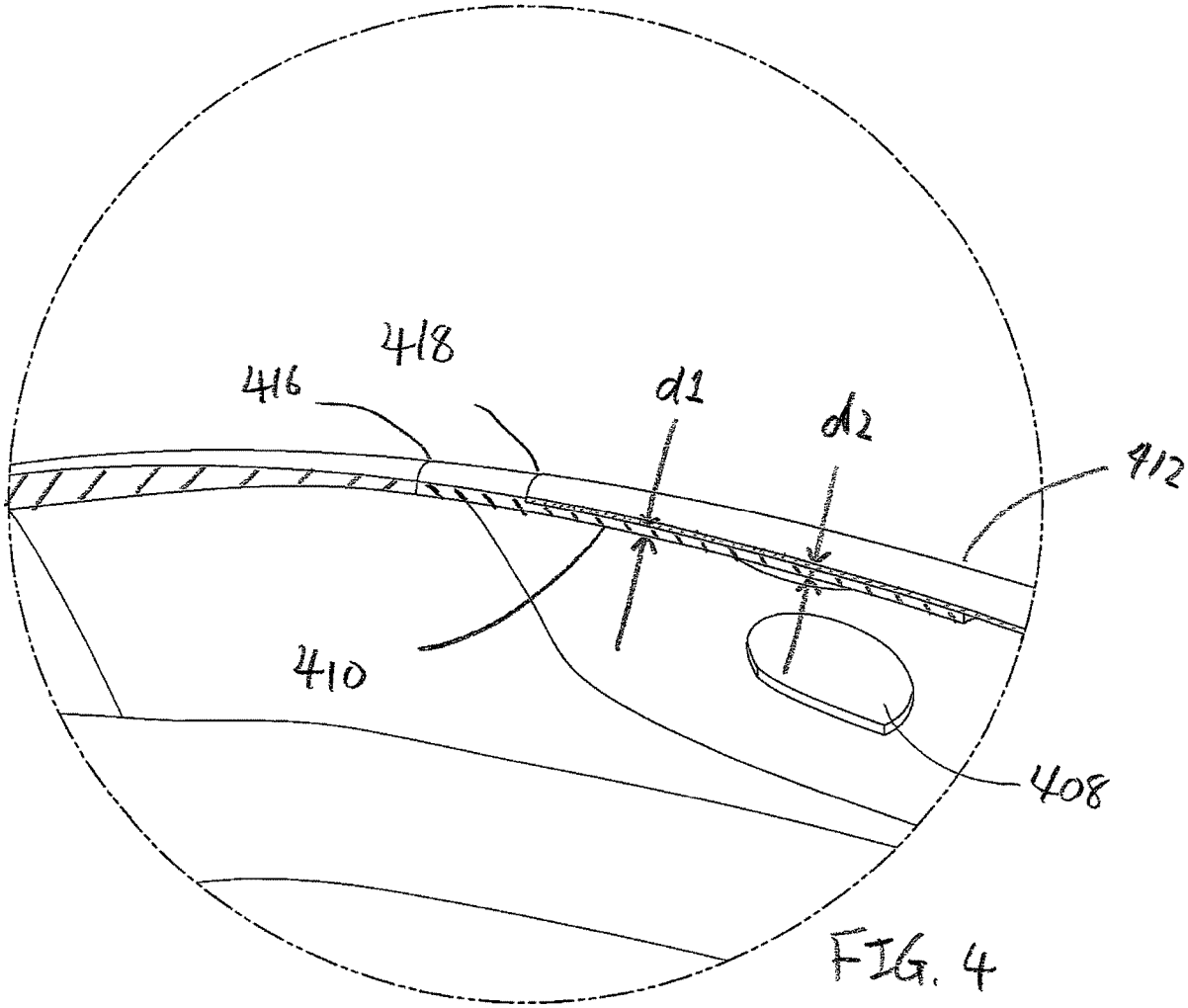
FIG. 4 of the accompanying drawings shows an enlarged cross-sectional view of a portion of a golf club head identified by circular region A shown in FIG. 3.

FIG. 4 of the accompanying drawings shows an enlarged cross-sectional view of a portion of a crown 304 of a golf club head 300 as illustrated by circular region A shown in FIG. 3. First and foremost, it should be noted that the base layer 410 shown in FIG. 4 may generally be attached to the frontal crown portion of the golf club head via a welding process, near welding joint 416. Since the base layer 410 and the frontal portion of the crown are both made out of a titanium type material, they may generally be welded together without any issues. Right behind the welding joint 416, it can be seen that the base layer 410 may have a step 418 to allow the lightweight cover layer 412 to be placed above the base layer 410. In one exemplary embodiment of the present invention, the lightweight cover layer 412 may be attached to the base layer 410 by using an adhesive type material. However, it should be noted that if a composite material is used, the lightweight cover layer 412 can be directly molded over the base layer 410 without departing from the scope and content of the present invention. In the current exemplary embodiment of the present invention, the base layer 410 may generally have a thickness d1 that is less than about 0.50 mm, more preferably less than about 0.40 mm, and most preferably less than about 0.35 mm, all without departing from the scope and content of the present invention. The lightweight cover layer 412 shown in this current exemplary embodiment of the present invention, due to the fact that is may be made out of a lightweight composite type material, may generally have a thickness d2 that is less than about 0.30 mm, more preferably less than about 0.25 mm, and most preferably less than about 0.20 mm.

It is worth noting here that although the above discussion focuses on the mass, thickness, and density of the different layers in order to reduce unnecessary mass and create discretionary mass, the crux of the current invention is based on the ability to achieve the mass savings without sacrificing the all-important sound and feel of the golf club head. Based on the discussion above one can clearly see that the material used for the lightweight cover layer, by the nature of having a lower density, can help reduce the mass of the golf club when it is used compared to standard titanium type material. However, the present invention recognizes that when lightweight material is used to replace traditional titanium materials, the sound and feel of the golf club head suffers. This degradation in the sound and feel of the golf club when lightweight material is used occurs because the acoustic vibration that occurs during impact with a golf ball will differ depending on the material.

The present invention not only recognizes the potential for degradation of sound, but also addresses this issue by finding the proper balance between the amount of mass saving achieved together with the preservation of the sound and feel of the golf club head. In order to achieve this harmonious balance, the present invention has found that by focusing on the amount of the lightweight cover layer 412 being exposed internally through the cutouts 408 of the base layer 410 will help preserve the acoustic signature and feel of the golf club head all while obtaining the discretionary mass desired. This amount of exposed lightweight cover layer 412 through the cutouts 408 is generally expressed as a percentage of the total internal surface area of the lightweight cover layer 412, and is extremely critical to the proper functionality of the present invention. More specifically, it can be said that in a preferred embodiment of the present invention, only between about 15% to about 60% of the internal surface area of the lightweight cover layer 412 is exposed internally through the cutouts 408, more preferably between about 20% to about 50%, and most preferably between about 25% to about 45%. The range of internal surface area exposed is critical to the proper functionality of the present invention because if too much of the lightweight cover layer 412 is exposed internally through the cutouts 408, the acoustic sound and feel of the golf club suffers. Alternatively, if too little of the internal surface area of the lightweight cover layer 412 is exposed through the cutouts 408, then the mass savings does not become significant enough to achieve any mass savings.

In order to quantify this very important percentage, the present invention has created a very simplistic term called the "Internal Exposure Percentage", defined as the internal surface area of the lightweight cover layer 412 that is exposed through the cutouts 408 divided by the total internal surface area of the lightweight cover layer 412. This "Internal Exposure Percentage" is summarized by Equation (1) below:

$$\text{Internal Exposure Percentage} = \frac{\text{Internal Surface Area Exposed through Cutouts}}{\text{Total Internal Surface Area}} \quad \text{Eq. (1)}$$

As described above, the Internal Exposure Percentage of a lightweight cover layer 412 for a golf club head in accordance with the present invention is most preferably between about 15% to about 60%, more preferably between about 20% to about 50%, and most preferably between about 25% to about 45%.

Figure 5:
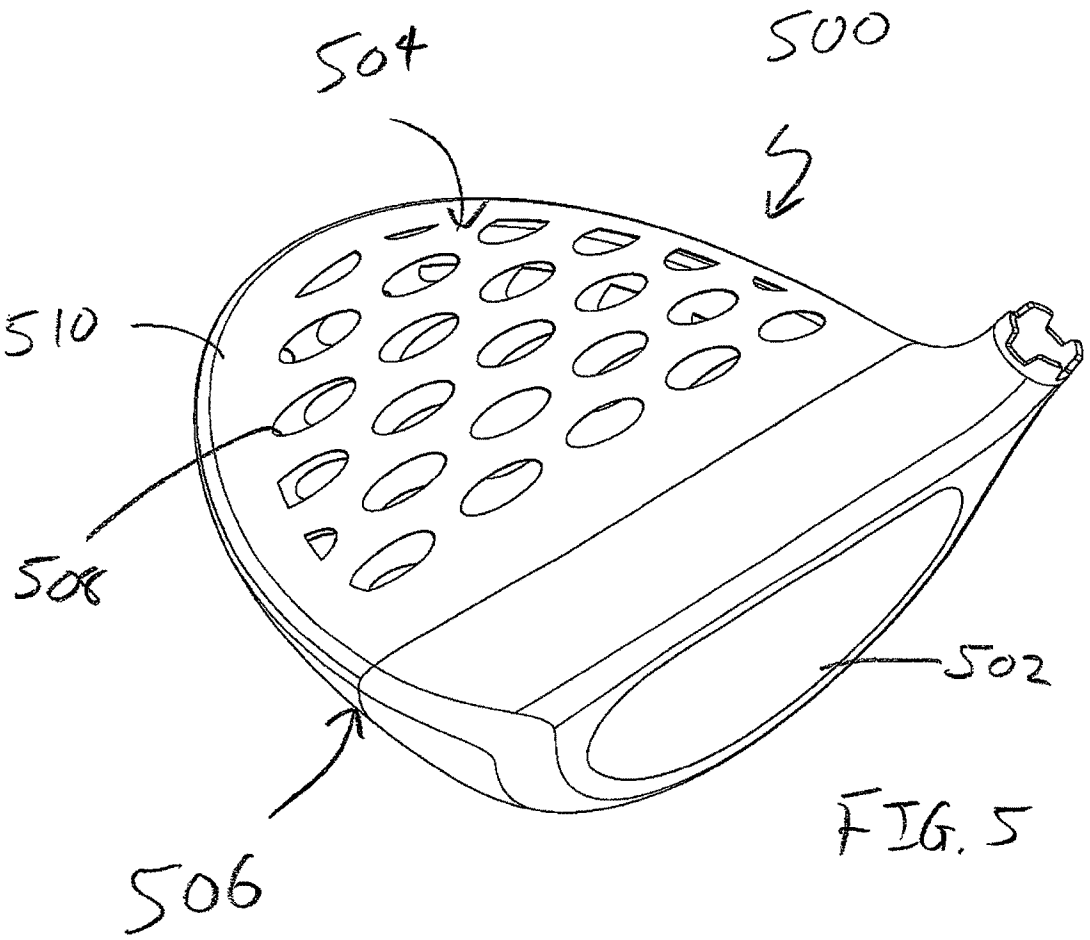
FIG. 5 of the accompanying drawings shows a perspective view of a golf club head in accordance with an alternative embodiment of the present invention.

FIG. 5 of the accompanying drawings shows a perspective view of a golf club head 500 in accordance with an alternative embodiment of the present invention. In this embodiment of the present invention, the base layer 510 may not be limited to the crown portion 504 of the golf club head 500, but could be applied towards the sole portion 506 of the golf club head 500 without departing from the scope and content of the present invention. In order to provide a more clear illustration of the various components of the golf club head 500, FIG. 6 providing an exploded view is also provided.

Figure 6:
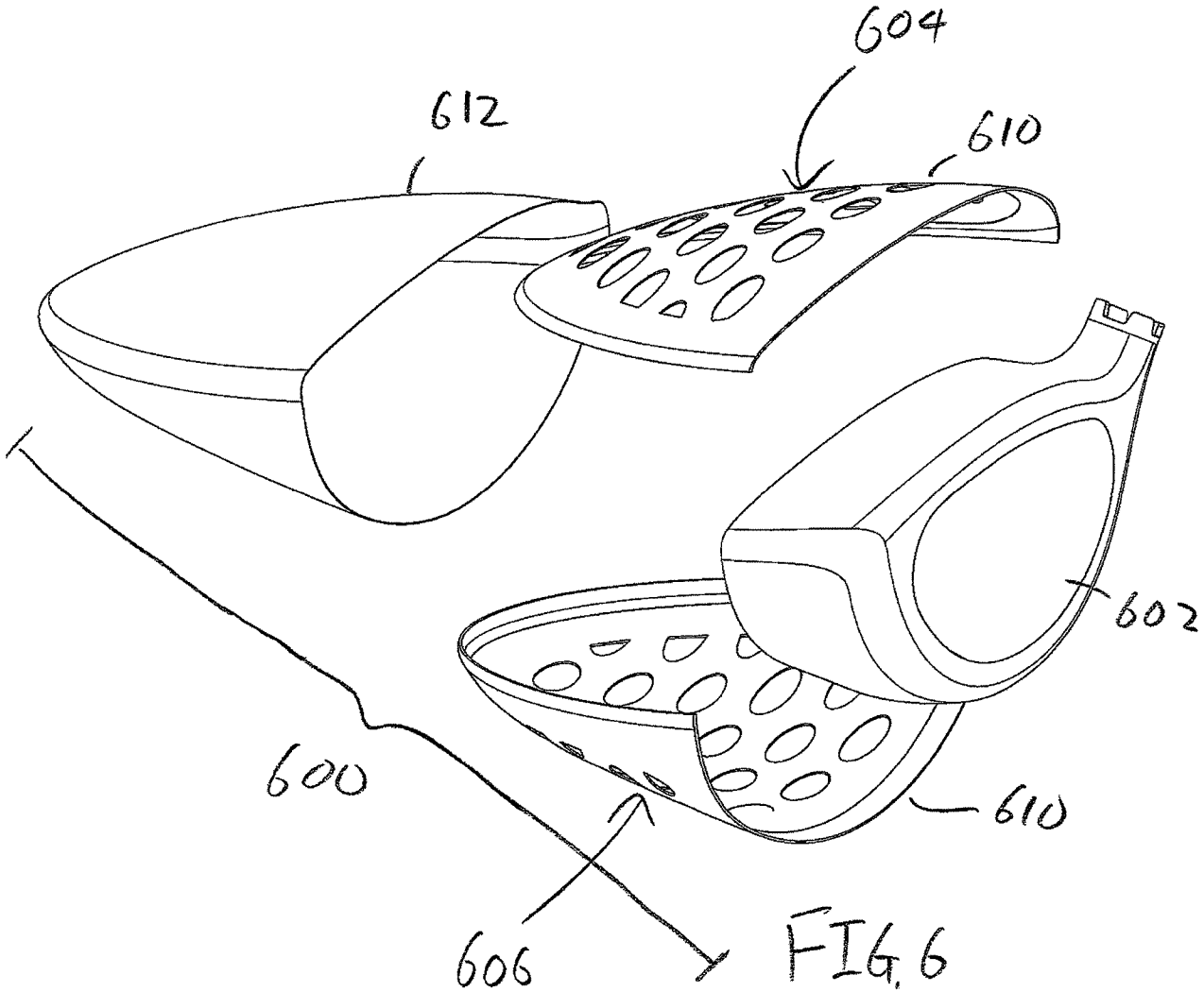
FIG. 6 of the accompanying drawings shows an exploded perspective view of a golf club head in accordance with the alternative embodiment of the present invention shown in FIG. 5.

FIG. 6 of the accompanying drawings shows an exploded perspective views of a golf club head 600 in accordance with the alternative embodiment of the present invention shown in FIG. 5. In this exploded view of the present invention, it can be seen that the sole 606 portion of the golf club head 600 may also contain a base layer 610 in addition its utilization in the crown 604 portion. In addition to the above, FIG. 6 also illustrates the shape and dimension of the lightweight cover layer 612, which was previously removed from FIG. 5 to illustrate the cutouts 508. The cover layer 612 does not need to be substantially planar as shown originally in FIG. 2, but rather could take on the external shape of a golf club head like a skin without departing from the scope and content of the present invention. It should be noted here that although the base layer 610 covers more of the golf club head, the percentage of internally exposed lightweight cover layer 612 is maintained to preserve the perfect balance between mass savings and preservation of sound and feel.

Figure 7:
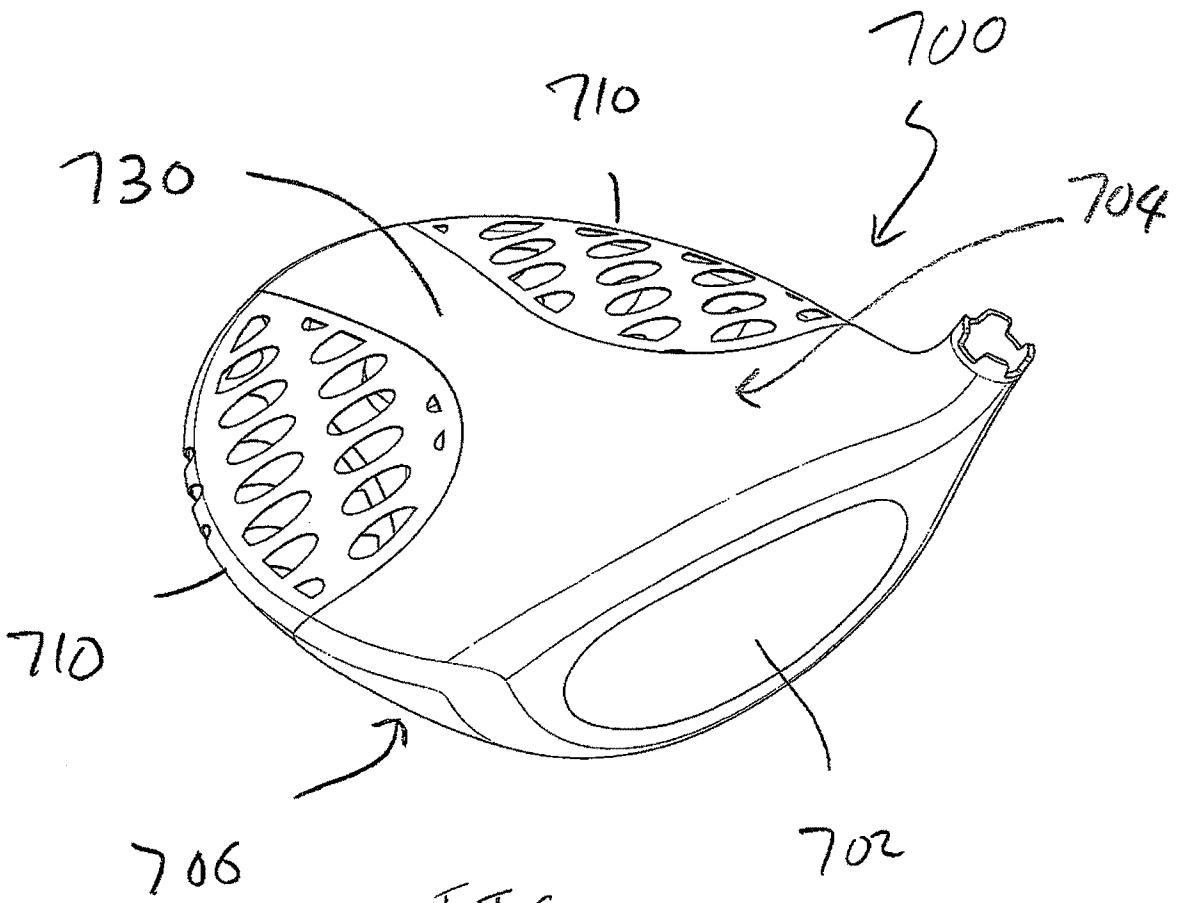
FIG. 7 of the accompanying drawings shows a perspective view of a golf club head in accordance with a further alternative embodiment of the present invention.

FIG. 7 of the accompanying drawings shows another perspective view of a golf club head 700 in accordance with a further alternative embodiment of the present invention. More specifically, in this alternative embodiment of the present invention the base layer 710 may be used at the toe and heel portion of the body of the golf club head 700 allowing the central portion of the golf club head 700 to create a bridge member 730 without departing from the scope and content of the present invention. Alternatively speaking, it can be said that the bridge member 730 separates the body portion into a heel body portion and a toe body portion. The bridge member 730, as shown in this exemplary embodiment of the present invention, may generally help create more structural rigidity within the golf club head 700, allowing the base layer 710 to be even thinner in some instances.

Figure 8:
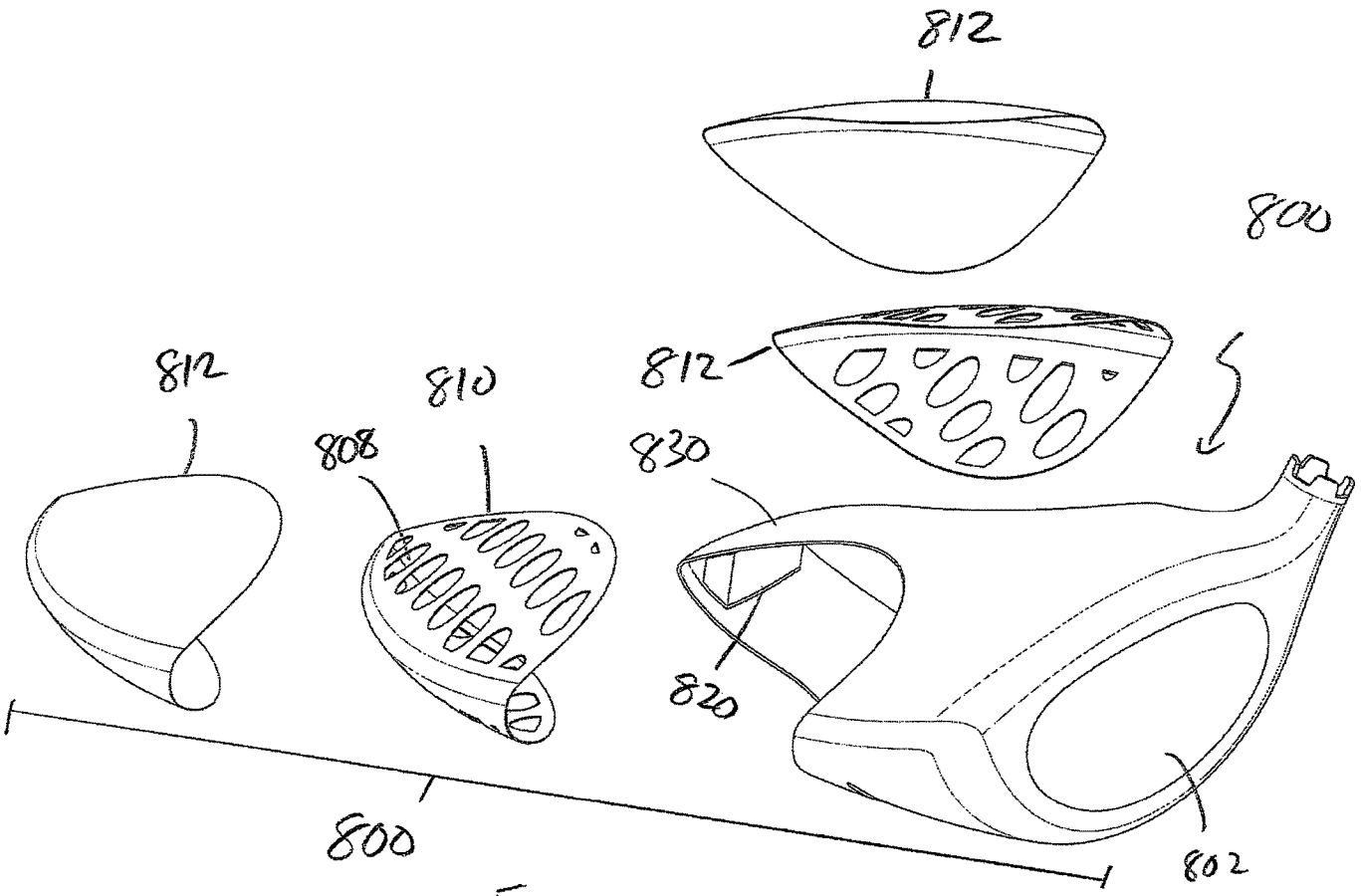
FIG. 8 of the accompanying drawings shows an exploded perspective view of a golf club head in accordance with the further alternative embodiment of the present invention shown in FIG. 7.

FIG. 8 of the accompanying drawings shows an exploded perspective view of the golf club head 800 shown in FIG. 7. This exploded perspective view not only allows the lightweight cover layer 812 to be shown more clearly, but also illustrates the mass member 820 located at the rear portion of the golf club head 800. It can be seen in this exploded perspective view that the mass member 820 is located along the bridge member 830 to allow the mass member 820 to be secured to the golf club head 800 without any need for additional features. Finally, it is worth noting that even in this alternative embodiment of the present invention, the golf club head will have the same percentage of internally exposed lightweight cover layer 812 through the cutouts 808 as previously discussed in order to preserve the perfect balance between mass savings and the preservation of sound and feel.

Figure 9:
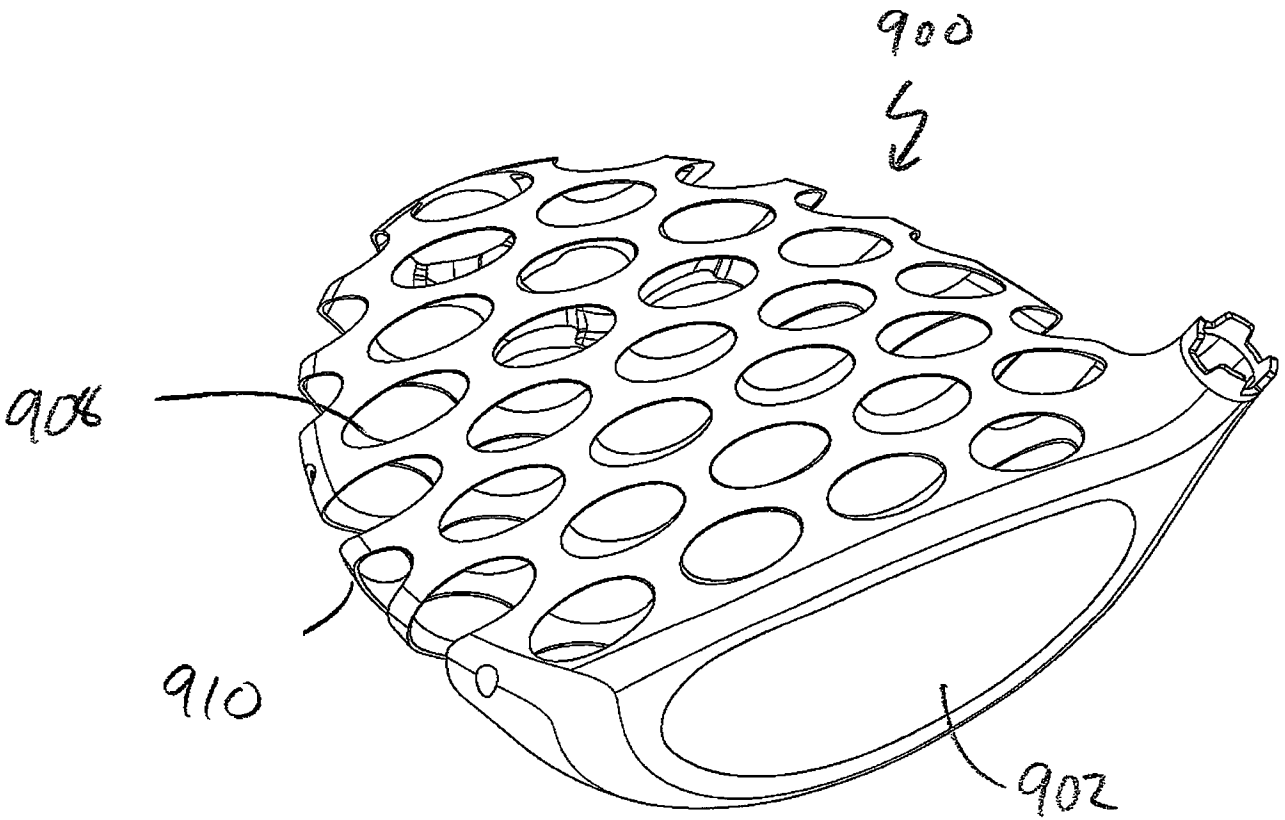
FIG. 9 of the accompanying drawings shows a perspective view of a golf club head in accordance with an even further alternative embodiment of the present invention.

FIG. 9 of the accompanying drawings shows a perspective view of a golf club head 900 in accordance with a further alternative embodiment of the present invention. In this alternative embodiment of the present invention the golf club head 900 could incorporate the plurality of cutouts 908 through the entire body portion to create the base layer 910. This golf club head 900 may generally be covered with a lightweight cover layer as previously discussed in prior embodiments, but the cover layer is not shown in FIG. 9 to allow more clarity of the internal structure.

Figure 10:
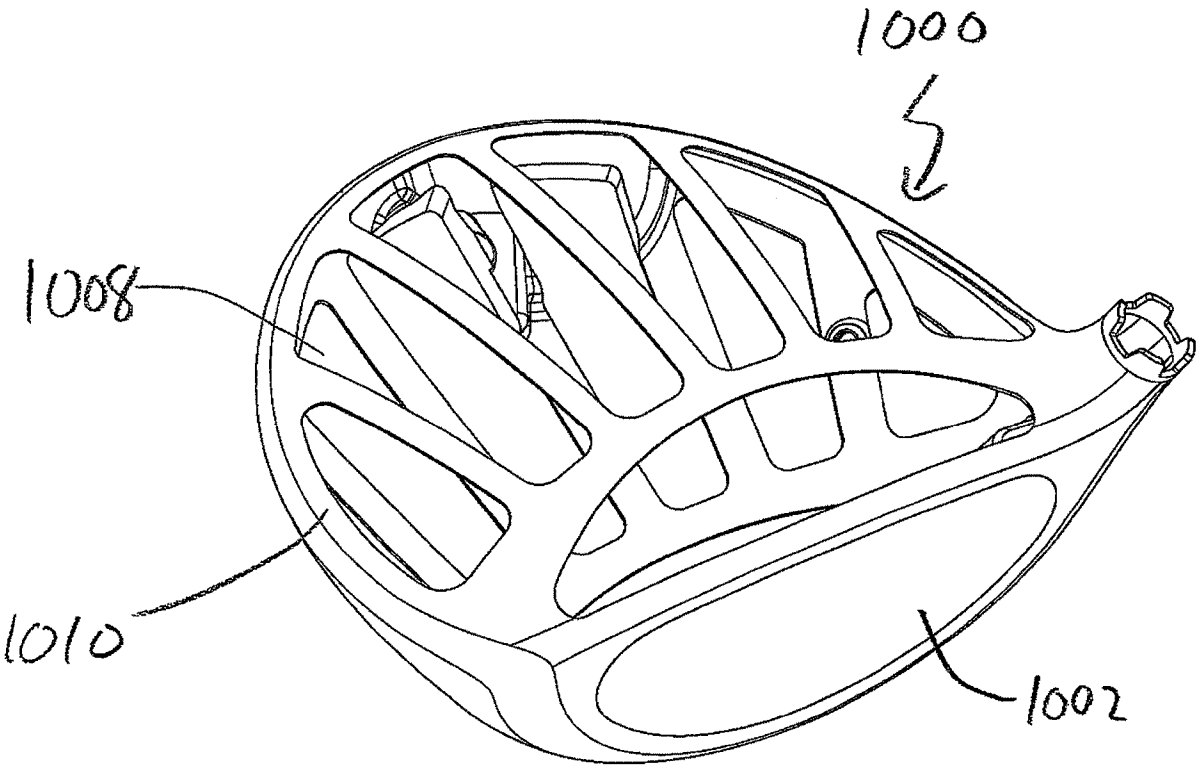
FIG. 10 of the accompanying drawings shows a perspective view of a golf club head in accordance with another further alternative embodiment of the present invention.

FIG. 10 of the accompanying drawings shows a perspective view of a golf club head 1000 in accordance with a further alternative embodiment of the present invention. FIG. 10 shows a slightly different internal structure wherein the base layer 1010 may be created using cutouts 1008 that is not circular in shape. In fact, in alternative embodiments of the present invention the cutouts 1008 may take on any shape that is circular, oval, rectangular, or any other shape all without departing from the scope and content of the present invention so long as it has an internal exposure percentage in accordance with the discussion above.

Figure 11:
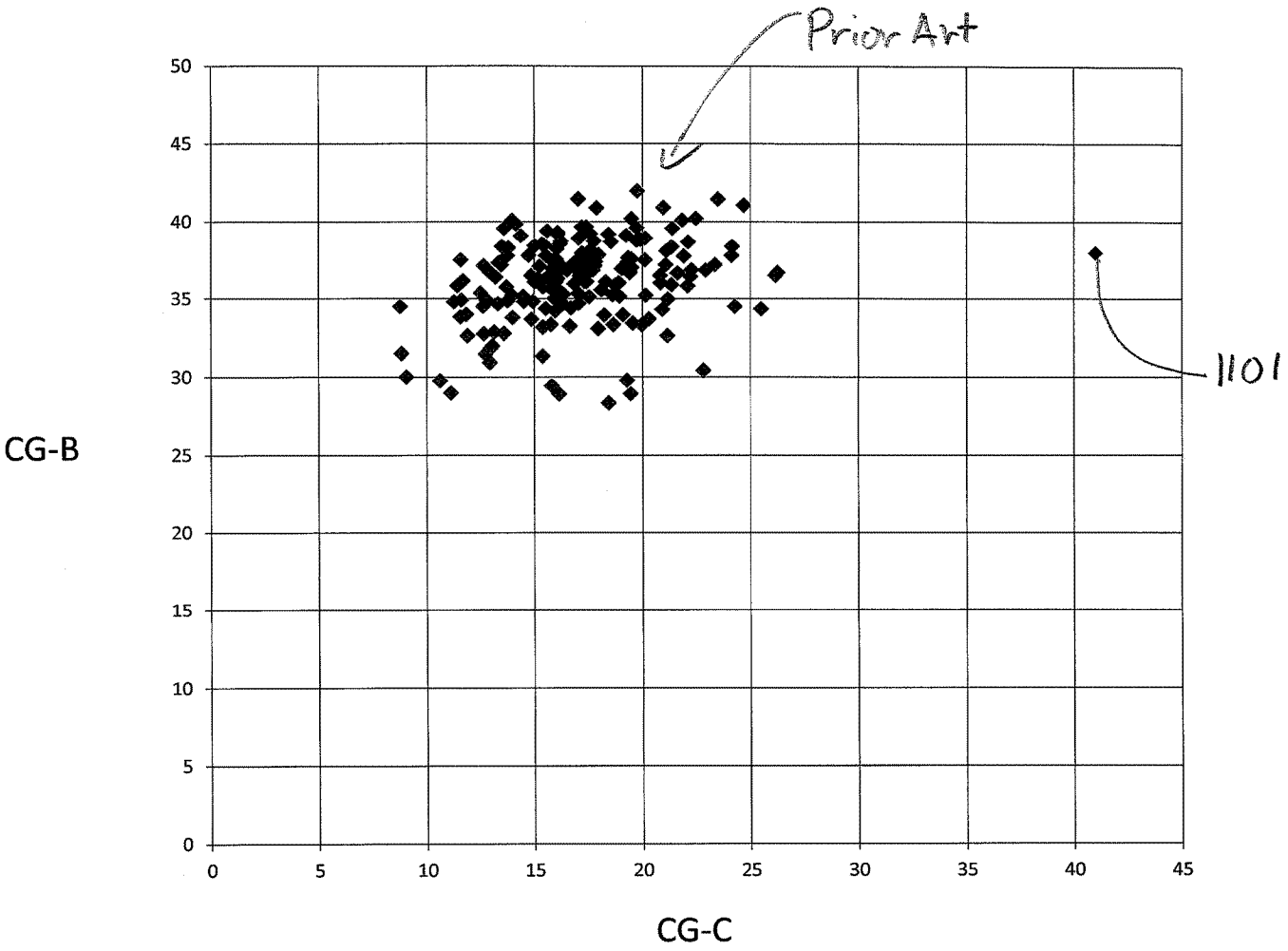
FIG. 11 of the accompanying drawings shows a graphical representation of a Center of Gravity location of the current golf club head compared to prior art golf club heads.

FIG. 11 of the accompanying drawings shows a chart indicating the potential CG location that could be achieved in a golf club head that incorporates the multi-material technology associated with the present invention. In FIG. 11, the x-axis is representative of the location of the CG away from the shaft axis in a forward to aft orientation called CG-C, while the y-axis is representative of the location of the CG location away from the shaft axis in a heel to toe orientation called CG-B. More details regarding the definition of the x and y axes, shown in FIG. 11 as CG-C and CG-B respectively, will be illustrated in subsequent FIG. 12. It should be noted that in FIG. 11, the prior art CG locations are all concentrated near a cluster with a CG-B between about 35 mm to about 45 mm, and a CG-C location between about 7 mm to about 27 mm. The current invention has a CG location at point 1101, which indicates that it is capable of achieving a CG-B location of about 37 mm and a CG-C location of greater than about 40 mm.

Figure 12A:
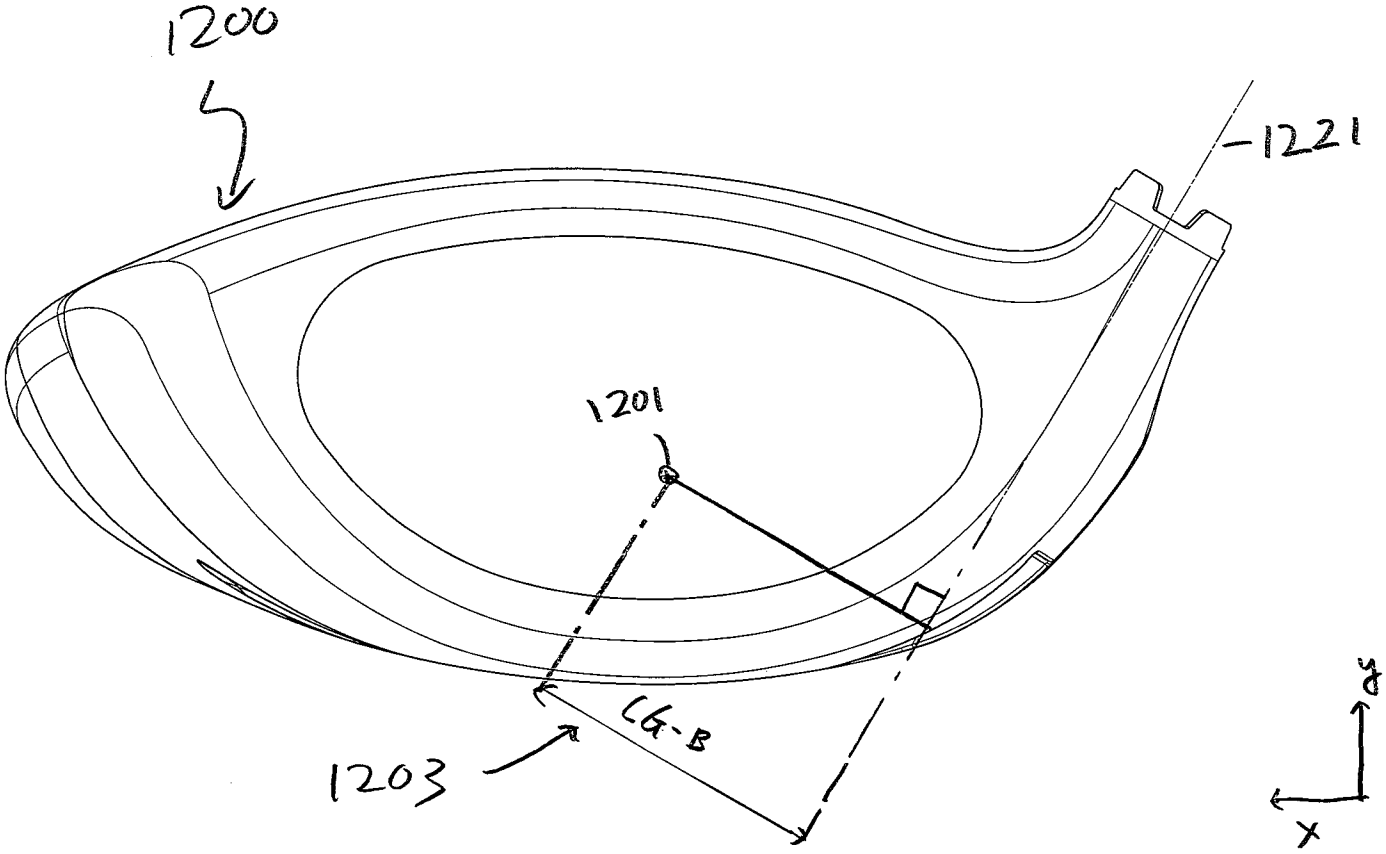
FIG. 12A of the accompanying drawings shows a frontal view of a golf club head illustrating one of the measurements used for defining CG location of a golf club head.
Figure 12B:
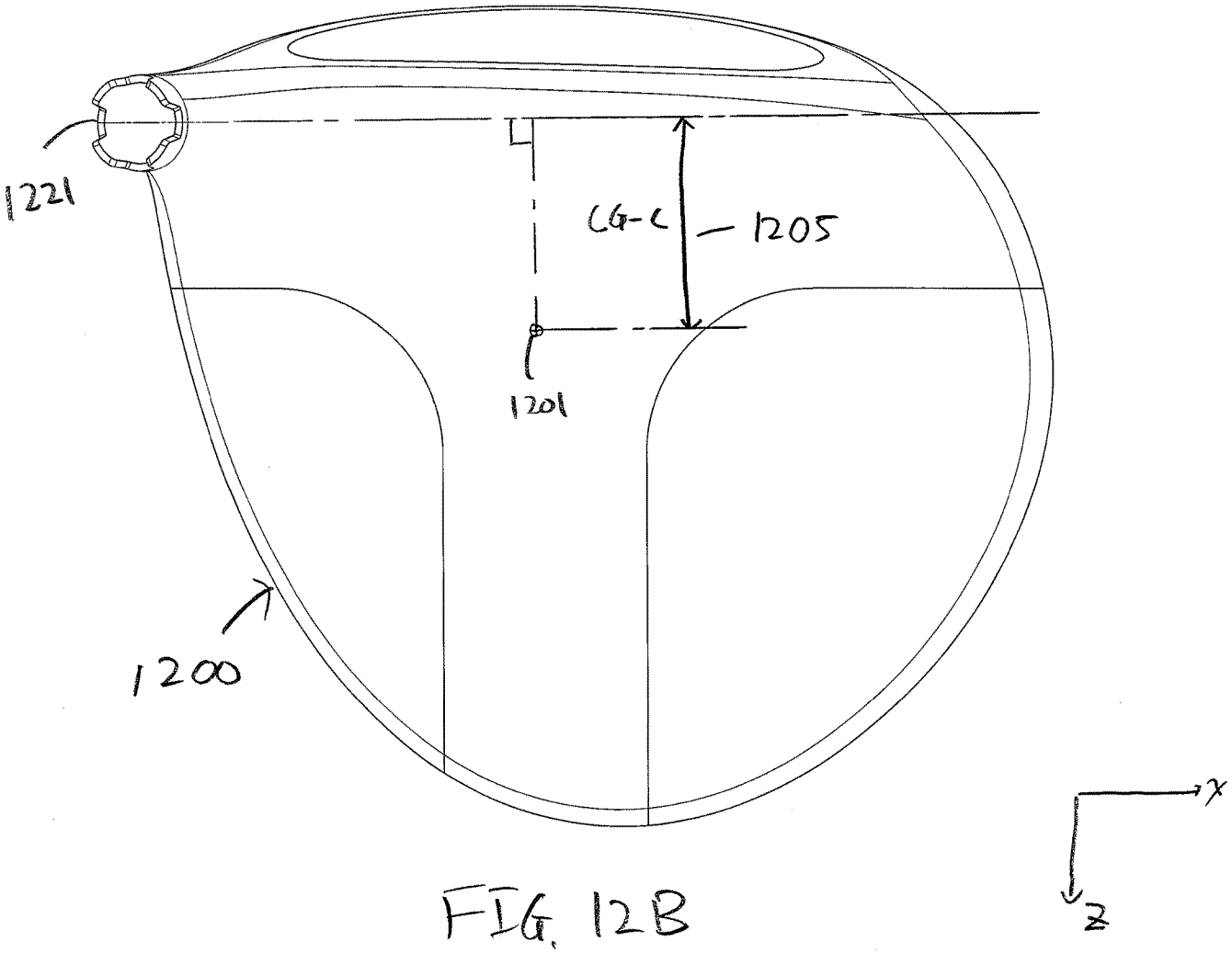
FIG. 12B of the accompanying drawings shows a top view of a golf club head illustrating another measurement used for defining CG location of a golf club head.

In order to further explain the definition of CG-B and CG-C, FIGS. 12A and 12B have been provided here. FIG. 12A shows a frontal view of a golf club head 1200 and the measurement of the CG-B is shown here as being the distance 1203 between the hosel bore axis 1221 and the CG location 1201. It should be noted that CG-B is defined as the location of the CG location 1201 being perpendicular to the hosel bore axis in the x-y plane, as a function of the lie angle of the golf club head 1200. Needless to say, different golf club heads with different lie angles will yield different CG-B results, but the ability to place the CG location 1201 away from the hosel bore axis 1221 is depicted here in FIG. 12A.

FIG. 12B shows a top view of a golf club head 1200 allowing the measurement of CG-C distance 1205 to be shown more clearly. CG-C, as shown in FIG. 12B, is defined as the location of the CG 1201 measured in a perpendicular direction along the x-z plane moving rearward of the club head 1200.

When viewing FIG. 11 in combination with FIGS. 12A and 12B, it can be seen here that the present invention, by utilizing the multi-material technology, is capable of achieving an extremely aggressive CG location in the forward to aft orientation, depicted as CG-C. Moreover, the present invention is capable of achieving this extreme CG-C compared to the prior art, without sacrificing the CG-B values. Alternatively speaking, it can be said that a golf club in accordance with the present invention may be capable of achieving a CG-C measurement of greater than about 30 mm, more preferably greater than about 35 mm, and most preferably greater than about 40 mm all without departing from the scope and content of the present invention.

Figure 13:
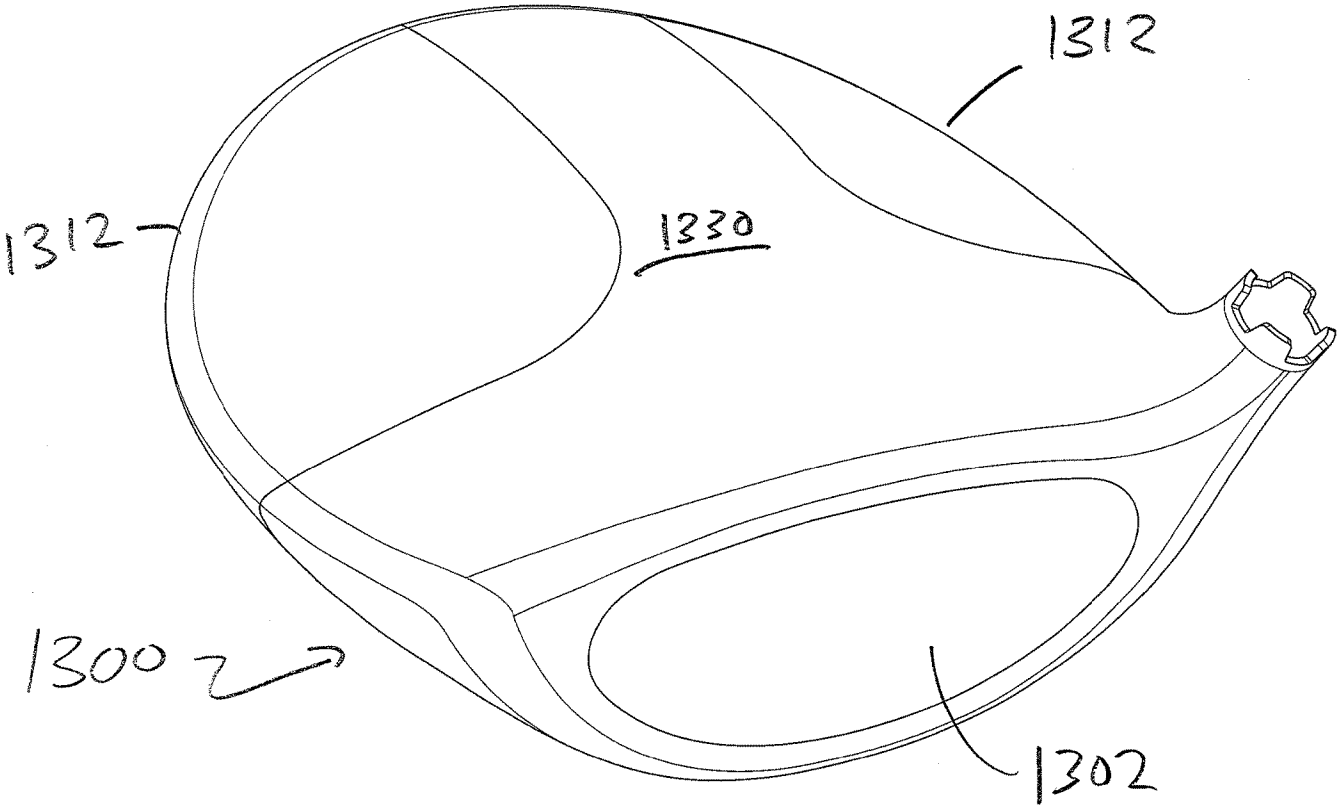
FIG. 13 of the accompanying drawings shows a perspective view of a golf club head in accordance with an alternative embodiment of the present invention.

FIG. 13 of the accompanying drawings shows a perspective view of a golf club head 1300 in accordance with a further alternative embodiment of the present invention. At first glance, the embodiment of the golf club head 1300 shown in FIG. 13 may look similar to golf club head 700 shown in FIG. 7 in that golf club head 1300 also has a striking face 1302 and a bridge member 1330. However, the present embodiment differs from golf club head 700 in that golf club head 1300 completely removes the need of a base layer, and only incorporates a lightweight cover layer 1312 at the toe and heel side of the bridge member 1330. In this alternative embodiment of the present invention, the lightweight cover layer 1312 may be a lightweight high strength titanium material having a density of between about 4.0 $g/cm^3$ and about 4.7 $g/cm^3$, more preferably between 4.1 $g/cm^3$ and about 4.6 $g/cm^3$, and most preferably about 4.5 $g/cm^3$.

Figure 14:
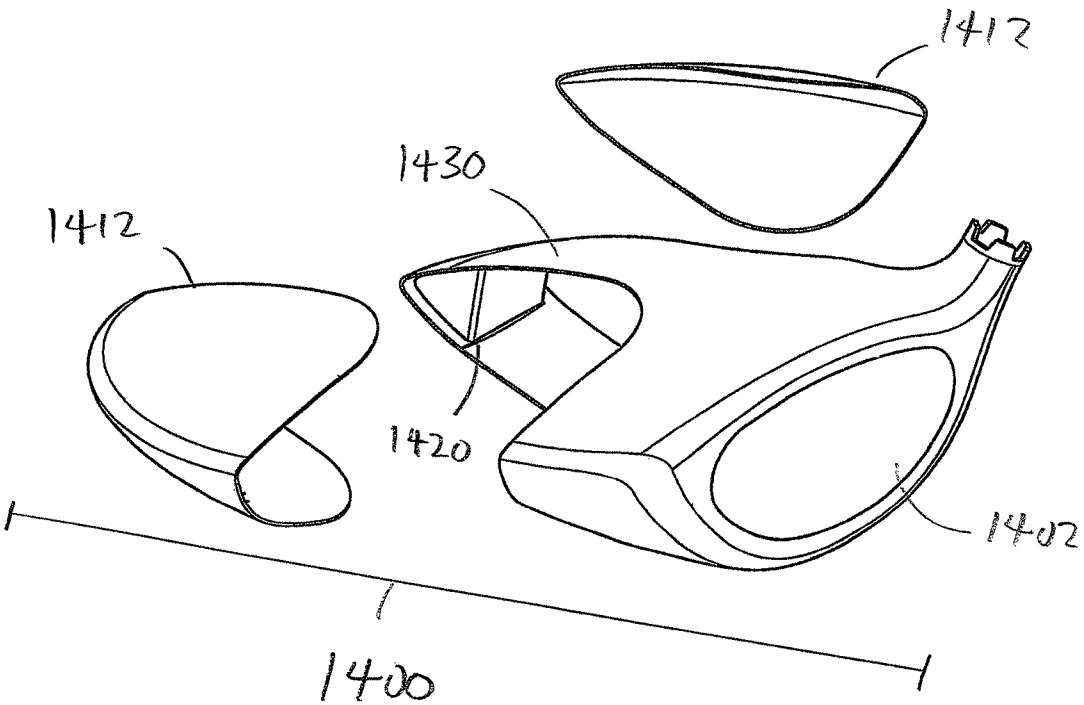
FIG. 14 of the accompanying drawings shows an exploded perspective view of a golf club head in accordance with an alternative embodiment of the present invention.

FIG. 14 of the accompanying drawings is provided here to provide a clearer illustration of the construction of a golf club head in accordance with this alternative embodiment by separating the various components of golf club head 1400. The exploded perspective view of golf club head 1400 shown in FIG. 14 illustrates that in this current embodiment of the present invention, the lightweight cover 1412 creates the rear heel and rear toe portion of the golf club head 1400 without the need for a base layer. This embodiment of the present invention may generally utilize a higher strength material for the lightweight cover 1412, as it needs to create more structural rigidity than prior embodiments where the base layer exists.

Figure 15:
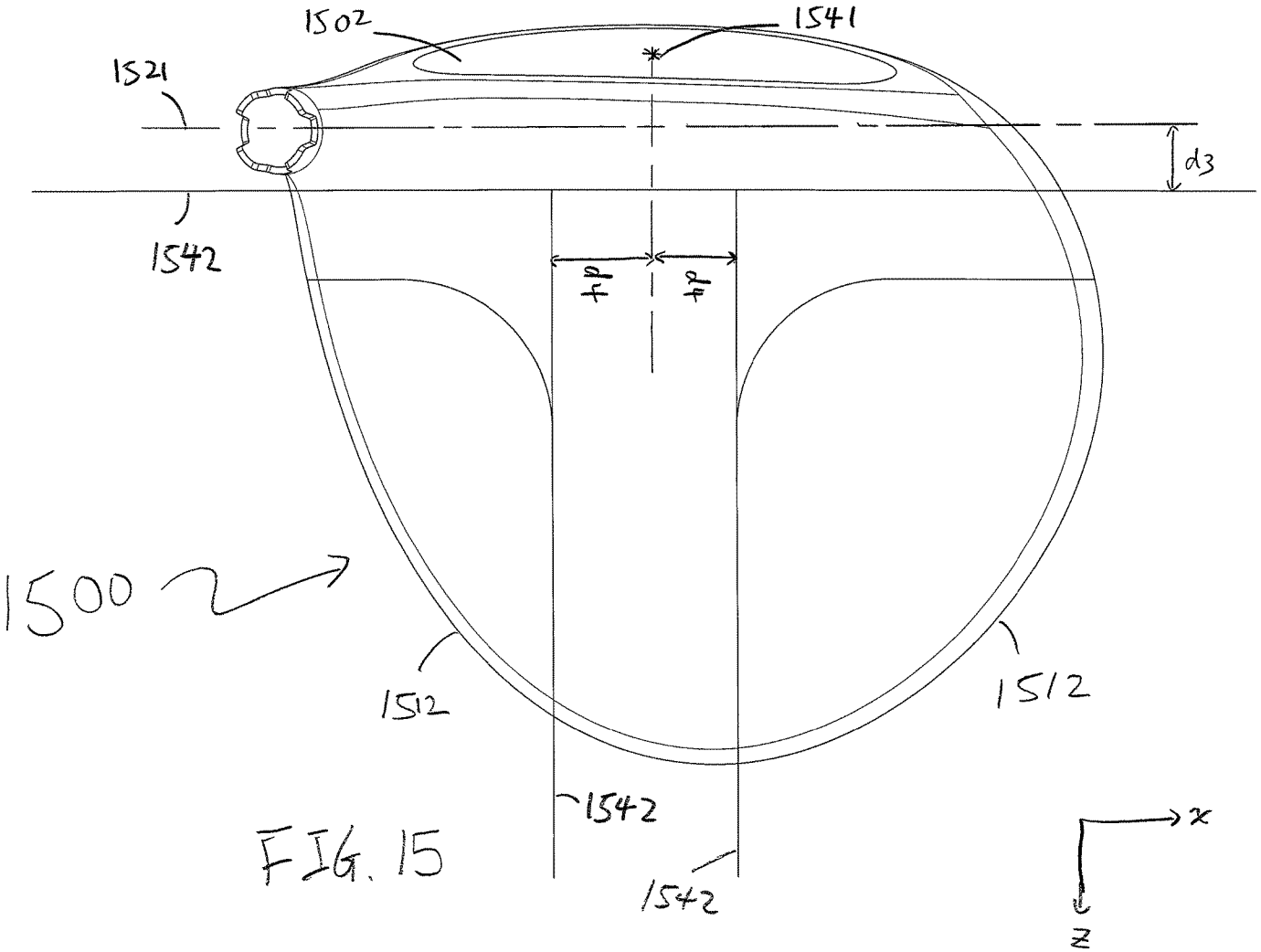
FIG. 15 of the accompanying drawings shows a top view of a golf club head in accordance with an alternative embodiment of the present invention.

In order to further illustrate the weight distribution of the current exemplary embodiment of the present invention, FIG. 15 is provided herein showing a top view of a golf club head 1500 that divides the golf club head 1500 into four separate components. The present invention utilizing the multi-material technology can help minimize the weight of the heel and toe body portions of the golf club head to increase the weight of the golf club head 1500 in the central portion to help achieve the CG locations discussed above. In this exemplary embodiment of the invention, the first bifurcation line 1542 separates the frontal portion of the golf club head 1500 from the rear body portion of the golf club head 1500. The bifurcation line 1542 is measured from the hosel bore axis 1521, and is set rearward along the z-axis at a distance d3 of 10 mm. Once the bifurcation line 1542 is created, two trifurcation lines 1542 are drawn to separate the rear body portion into three separate components. The two trifurcation lines 1542 are defined using the geometric center 1541 of the striking face 1502 and offset a distance d4 of 15 mm in both the heel and toe direction along the x-axis. Once these sections are defined, FIG. 16 can be used to further explain the weighting aspects of the current inventive golf club head 1500.

Figure 16:
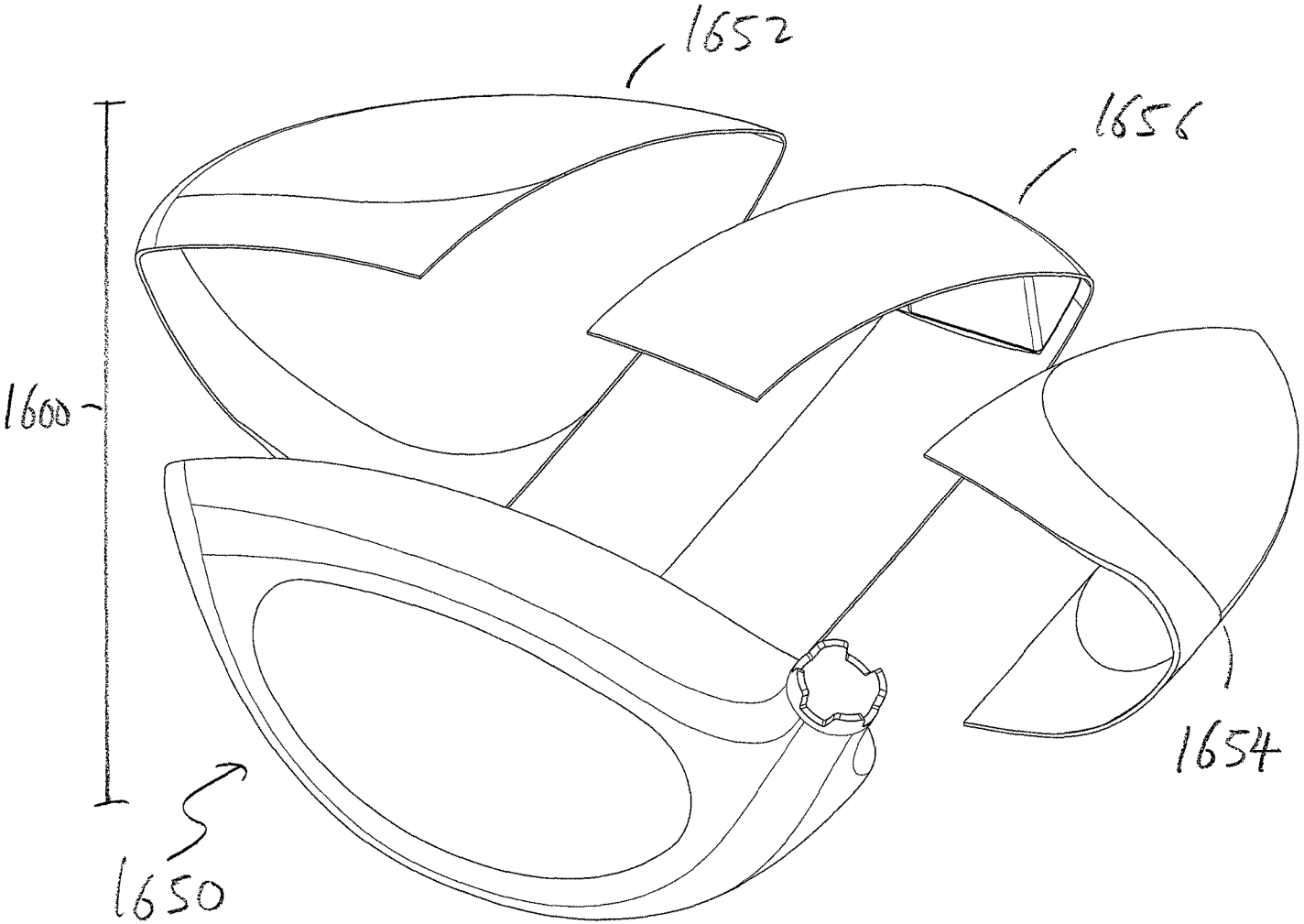
FIG. 16 of the accompanying drawings shows an exploded perspective view of a golf club head separated into four different pieces according to a methodology described in the present invention.

FIG. 16 of the accompanying drawings shows an exploded perspective view of a golf club head 1600 that is divided using the very specific dimensions articulated above. The golf club head 1600 here is separated into four different parts, identified as frontal portion 1650, rear toe portion 1652, rear heel portion 1654, and rear central portion 1656. A golf club in accordance with an exemplary embodiment of the present invention may generally have a lightweight rear toe portion 1652 and a lightweight rear heel portion 1654, while having a significantly heavier rear central portion 1656. Alternatively speaking, it can be said that the mass of either of the rear toe portion 1652 or the rear heel portion 1654 is lighter than the mass of the rear central portion 1656. In fact, the mass of the rear toe portion 1652 and the rear heel portion 1654 are so light relative to the rear central portion 1656, it can be said that the combined mass of the rear toe portion 1652 and the rear heel portion 1654 is still less than the mass of the rear central portion 1656. In order to understand the dramatic difference in mass between the different regions, it can be said the ratio of the mass of the rear toe portion 1652 combined with the mass of the rear heel portion 1654 all divided by the mass of the rear central portion 1656 is less than 1.00, more preferably less than about 0.80, and most preferably less than about 0.65.

In one exemplary embodiment of the present invention, the mass of the rear toe portion 1652 may generally be less than about 30 grams, more preferably less than about 25 grams, and most preferably less than about 22 grams. In this exemplary embodiment of the present invention, the mass of the rear heel portion 1654 may generally be less than about 20 grams, most preferably less than about 17 grams, and most preferably less than about 15 grams. Finally, the rear central portion 1656 in this embodiment may have a mass that is greater than about 50 grams, more preferably greater than about 55 grams, and most preferably greater than about 58 grams.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head; and a body portion attached to an aft portion of said striking face portion further comprising a bridge member creating a heel body portion and a toe body portion;

wherein said golf club head has a Center of Gravity location having a CG-C location greater than about 30 mm, and wherein said heel body portion and said toe body portion further comprises a base layer and a lightweight cover layer, wherein said base layer further comprises a plurality of cutouts, and said lightweight cover layer has an Internal Exposure Percentage of between about 15% to about 60%.

2. The golf club head of claim 1, wherein said CG-C location is greater than about 35 mm.

3. The golf club head of claim 1, wherein said CG-C location is greater than about 40 mm.

4. The golf club head of claim 1, wherein said lightweight cover layer has an Internal Exposure Percentage of between about 20% to about 50%.

5. The golf club head of claim 4, wherein said lightweight cover layer has an Internal Exposure Percentage of between about 25% to about 45%.

6. The golf club head of claim 1, wherein said heel body portion and said toe body portion only consists a lightweight cover layer, wherein said lightweight cover layer has a density of between 4.0 $g/cm^3$ and about 4.7 $g/cm^3$.

7. The golf club head of claim 6, wherein said lightweight cover layer has a density of between about 4.1 $g/cm^3$ and about 4.6 $g/cm^3$.

8. The golf club head of claim 7, wherein said lightweight cover layer has a density of less than about 4.5 $g/cm^3$.

9. The golf club head of claim 8, wherein said lightweight cover layer has a maximum thickness of less than about 0.50 mm.

10. The golf club head of claim 9, wherein said lightweight cover layer has a maximum thickness of less than about 0.40 mm.

11. The golf club head of claim 10, wherein said lightweight cover layer has a maximum thickness of less than about 0.35 mm.

* * * * *